US006174246B1

(12) United States Patent
Hase et al.

(10) Patent No.: US 6,174,246 B1
(45) Date of Patent: Jan. 16, 2001

(54) MULTI-PIECE SOLID GOLF BALL

(75) Inventors: Toshiya Hase; Shinya Ono, both of Kanagawa (JP)

(73) Assignee: The Yokohama Rubber Co.,Ltd., Tokyo (JP)

( * ) Notice: Under 35 U.S.C. 154(b), the term of this patent shall be extended for 0 days.

(21) Appl. No.: 09/320,143

(22) Filed: May 26, 1999

(30) Foreign Application Priority Data

May 27, 1998 (JP) ..... 10-145506

(51) Int. Cl.[7] ..... A63B 37/04; A63B 37/06

(52) U.S. Cl. ..... 473/373; 473/371; 473/372; 473/373; 473/374

(58) Field of Search ..... 473/371–374

(56) References Cited

U.S. PATENT DOCUMENTS 5,314,187 * 5/1994 Proudfit ..... 273/235 R
5,490,674 * 2/1996 Hamada et al. ..... 473/373
5,559,188 * 9/1996 Egashira et al. ..... 525/74

FOREIGN PATENT DOCUMENTS 60-241464 5/1984 (JP) .
2-228978 1/1989 (JP) .
6-079017 * 3/1994 (JP) .
8-112375 * 5/1996 (JP) .
9-108384 * 4/1997 (JP) .
10-113406 * 5/1998 (JP) .

* cited by examiner

*Primary Examiner*—Stephen F. Gerrity
*Assistant Examiner*—Paul D. Kim
(74) *Attorney, Agent, or Firm*—Finnegan, Henderson, Farabow, Garrett, Dunner, L.L.P.

(57) ABSTRACT

A multi-piece solid golf ball which comprises a core consisting of an inner layer core and an outer layer core and a cover layer for covering the core, wherein the diameter of the inner layer core is 20 to 35 mm, the thickness of the outer layer core is 2 to 11 mm, the Shore D hardness (A) of the surface of the inner layer core and the Shore D hardness (B) of the surface of the outer layer core satisfy relational expressions, $15 \leqq (A) \leqq 50$, $35 \leqq (B) \leqq 70$ and $(A) \leqq (B)$, and the cover layer is made from a resin composition comprising 50 to 90 parts by weight of an ionomer resin and 50 to 10 parts by weight of diene-based rubber. This multi-piece solid golf ball is excellent in impact resilience, flying performance, shot feeling and durability.

3 Claims, No Drawings

MULTI-PIECE SOLID GOLF BALL

BACKGROUND OF THE INVENTION

1. Field of the Invention

The present invention relates to a multi-piece solid golf ball and, specifically, to a multi-piece solid golf ball which is excellent impact resilience, flying performance, shot feeling and durability.

2. Description of the Related Art

A multi-piece solid golf ball is a golf ball comprising two or more core layers or two or more cover layers and is now being developed to improve a shot feeling which is the demerit of a two-piece solid golf ball while retaining or improving impact resilience and flying performance which are the merits of the two-piece solid golf ball.

For example, Japanese Patent Application Laid-open No. Sho 60-241464 proposes a multi-piece solid golf ball comprising an inner layer core and an outer layer core which differ from each other in specific gravity. However, compared with the two-piece solid golf ball, this multi-piece solid golf ball has a good driving feeling but is inferior in impact resilience. Meanwhile, Japanese Patent Application Laid-open No. Hei 2-228978 proposes a multi-piece solid golf ball comprising two core layers which differ from each other in hardness. However, since there is a large difference in hardness between the inner layer core and the outer layer core, breakage readily occurs from the interface between these layers and this multi-piece solid golf ball lacks durability.

Although many multi-piece solid golf balls other than the above ones are proposed, none of them satisfies all requirements for shot feeling, impact resilience, flying performance and durability.

SUMMARY OF THE INVENTION

It is an object of the present invention to provide a multi-piece solid golf ball which is excellent impact resilience, flying performance, shot feeling and durability.

That is, the present invention provides a multi-piece solid golf ball which comprises a core consisting of an inner layer core and an outer layer core and a cover layer for covering the core, wherein the diameter of the inner layer core is 20 to 35 mm, the thickness of the outer layer core is 2 to 11 mm, the Shore D hardness (A) of the surface of the inner layer core and the Shore D hardness (B) of the surface of the outer layer core satisfy relational expressions, $15 \leqq (A) \leqq 50$, $35 \leqq (B) \leqq 70$ and $(A) \leqq (B)$, and the cover layer is made from a resin composition comprising 50 to 90 parts by weight of an ionomer resin and 50 to 10 parts by weight of diene-based rubber.

Preferably, the specific gravity (C) of the inner layer core and the specific gravity (D) of the outer layer core satisfy relational expressions, $1.0 \leqq (C) \leqq 1.5$, $1.0 \leqq (D) \leqq 1.5$ and $|(C)-(D)| \leqq 0.1$.

Preferably, the above diene-based rubber is dispersed in the ionomer resin and thermally crosslinked.

The surface of the cover layer preferably has a Shore D hardness of 40 to 70, more preferably 40 to 65.

DETAILED DESCRIPTION OF THE PREFERRED EMBODIMENTS

The present invention is a multi-piece solid golf ball which comprises a core consisting of an inner layer core and an outer layer core and a cover layer for covering the core, wherein the diameter of the inner layer core is 20 to 35 mm, the thickness of the outer layer core is 2 to 11 mm, the Shore D hardness (A) of the surface of the inner layer core and the Shore D hardness (B) of the surface of the outer layer core satisfy relational expressions, $15 \leqq (A) \leqq 50$, $35 \leqq (B) \leqq 70$ and $(A) \leqq (B)$, and the cover layer is made from a resin composition comprising 50 to 90 parts by weight of an ionomer resin and 50 to 10 parts by weight of diene-based rubber.

The cover layer of the multi-piece solid golf ball of the present invention is made from a resin composition comprising 50 to 90 parts by weight of an ionomer resin and 50 to 10 parts by weight of diene-based rubber. Since the cover layer contains diene-based rubber, durability is greatly improved and impact resilience, flying performance and shot feeling are also improved compared with a case where the cover layer is made from a resin composition containing an ionomer resin alone.

The ionomer resin contains an ethylene-unsaturated carboxylic acid copolymer as a base resin and is obtained from an ethylene-unsaturated carboxylic acid copolymer and a metal compound capable of supplying cations, for example.

The ethylene-unsaturated carboxylic acid copolymer is, for example, a copolymer of ethylene and an unsaturated carboxylic acid having 3 to 6 carbon atoms, such as acrylic acid, methacrylic acid, maleic acid, fumaric acid or vinyl benzoate.

The metal compound capable of supplying cations is, for example, a formate, acetate, nitrate, carbonate, bicarbonate, oxide, hydroxide, alkoxide or the like of an alkali metal, alkali earth metal or transition metal. Illustrative examples of the metal include sodium, zinc, lithium, magnesium, manganese, calcium, cobalt, potassium and the like.

The ionomer resin preferably has a Shore D hardness of 55 to 80. Since the surface of the cover layer preferably has a Shore D hardness of 40 to 70 as will be described hereinafter, when the Shore D hardness of the ionomer resin is higher than 80, the control of the hardness of the cover layer becomes difficult. When the Shore D hardness of the ionomer resin is higher than 55, the impact resilience of the cover layer become satisfactory.

Illustrative examples of the ionomer resin include metal salts of a copolymer of ethylene and methacrylic acid. The commercial products of the ionomer resin include Himilan 1605, Himilan 1706, Himilan 1707, Himilan AM7315, Himilan AM7317 and Himilan AM7318 of Mitsui Du Pont•Polychemical Co., Ltd. and Sarlin 7930 and Sarlin 7940 of Du Pont Co., Ltd. and the like.

Illustrative examples of the diene-based rubber used for the cover layer include natural rubber, butadiene rubber, isoprene rubber, styrene-butadiene copolymer rubber, ethylene-propylene-diene terpolymer rubber, acrylonitrile-butadiene copolymer rubber and the like. Butadiene rubber is preferred, and butadiene rubber having 40% or more of a cis-1,4 bond is particularly preferred. The commercial products of the diene-based rubber include BR-01, BR-11, BR-18 of Japan Synthetic Rubber Co., Ltd., Nipol 1220 of Nippon Zeon Co., Ltd., UBEPOL BR-210, 150L and 360L of Ube Corporation, and the like.

The particle diameter of the diene-based rubber is preferably 0.1 to 5 $\mu$m. This is because the impact resilience, durability and appearance of the cover layer become satisfactory.

The weight ratio of the ionomer resin to the diene-based rubber in the resin composition is 50/50 to 10/90. When the proportion of the ionomer resin is higher than the above range, the shot feeling becomes too hard. When the proportion of the diene-based rubber is higher than the above range, impact resilience and flying performance deteriorate.

Preferably, the diene-based rubber is dispersed in the ionomer resin and thermally crosslinked. The impact resilience, durability and appearance of the cover layer become satisfactory by thermal crosslinking. The expression "appearance becomes satisfactory" means that the cover layer has a good appearance without a nap. When not thermal crosslinking but a crosslinking agent is used, the following problem arises. For example, when crosslinking is carried out with an organic peroxide, the ionomer resin is crosslinked as well, thereby reducing the flowability of the cover layer and making molding difficult. When crosslinking is carried out with sulfur, the resin composition is colored yellow.

The Shore D hardness of the surface of the cover layer is preferably 40 to 70, more preferably 40 to 65, particularly preferably 55 to 65. Within the above range, durability becomes satisfactory. When the Shore D hardness is higher than 70, the shot feeling becomes hard and when the Shore D hardness is lower than 40, flying performance may deteriorate.

The resin composition preferably has a tan $\sigma$ at 0° C. of 0.01 to 0.07. This is because impact resilience become satisfactory.

The reason why tan $\sigma$ at 0° C. is set to 0.01 to 0.07 is the use of the ionomer resin having high hardness and the diene-based rubber having a low glass transition temperature.

The resin composition may contain other type of rubber, elastomer, filler, pigment, processing aid, stabilizer and the like as required in addition to the above components.

The method for producing the resin composition is not particularly limited but an ionomer resin and uncrosslinked diene-based rubber may be kneaded at a temperature of 150 to 260° C. to thermally crosslink the diene-based rubber and disperse it into the ionomer resin. It is recommended to carry out kneading in this case by stirring at a shear rate of 1,000/sec or more in a mixer. Since the diene-based rubber is well dispersed in the ionomer resin and the particle diameter of the dispersed diene-based rubber can be reduced to 5 $\mu$m or less by this stirring, the impact resilience, durability and appearance of the resin composition become satisfactory.

The multi-piece solid golf ball of the present invention is such that the diameter of the inner layer core is 20 to 35 mm, the thickness of the outer layer core is 2 to 11 mm, and the Shore D hardness (A) of the surface of the inner layer core and the Shore D hardness (B) of the surface of the outer layer core satisfy relational expressions, $15 \leqq (A) \leqq 50$, $35 \leqq (B) \leqq 70$ and $(A) \leqq (B)$ . The diameter of the inner layer core is preferably 20 to 30 mm. Further, (A) and (B) preferably satisfy relational expressions $20 \leqq (A) \leqq 45$ and $50 \leqq (B) \leqq 65$.

The illustrative examples of the preferable A and B combination are:

[A-B relation I] $20 \leqq (A) \leqq 30$ and $50 < (B) \leqq 70$

[A-B relation II] $30 \leqq (A) \leqq 45$ and $35 \leqq (B) < 60$

Further, when [A-B relation I (hereinafter abbreviated A-B I is used)], the ratio of (B)/(A) is preferably $1.8 \leqq (B)/(A) \leqq 3.0$. when [A-B relation II (hereinafter abbreviated A-B II is used)], the ratio of (B)/(A) is preferably $1.0 \leqq (B)/(A) \leqq 1.8$.

When the diameter of the inner layer core is smaller than 20 mm, the shot feeling becomes too hard and when the diameter of the inner layer core is larger than 35 mm, the shot feeling becomes too soft and durability deteriorates. When the diameter of the inner layer core is 20 to 30 mm, impact resilience are not impaired while an appropriate shot feeling is retained.

When the thickness of the outer layer core is smaller than 2 mm, impact resilience and flying performance become worse and when the thickness is 4 mm or more, impact resilience and flying performance become excellent. When the thickness of the outer layer core is larger than 11 mm, the diameter of the multi-piece solid golf ball becomes too large.

When $(A) \leqq (B)$, impact resilience and flying performance become satisfactory. When $(A) > (B)$, impact resilience and flying performance become worse and a pithy and hard shot feeling is provided.

When $(A) < 15$ and (B) is large, breakage readily occurs from the interface and when (B) is small, the shot feeling becomes too soft. When $(A) > 50$, the shot feeling becomes too hard. When $(B) < 35$, the shot feeling becomes too soft. When $(B) > 70$ and (A) is large, the shot feeling becomes too hard and when (A) is small, breakage readily occurs from the interface. When $20 \leqq (A) \leqq 45$ and $50 \leqq (B) \leqq 65$, impact resilience, flying performance, shot feeling and durability become well balanced.

In detail, when $20 \leqq (A) \leqq 30$ and $(B) \leqq 50$, the shot feeling becomes rather soft. When $20 \leqq (A) \leqq 30$ and $(B) > 70$, the shot feeling becomes rather hard.

When $30 \leqq (A) \leqq 45$ and $(B) < 35$, the shot feeling becomes rather soft. When $30 \leqq (A) \leqq 45$ and $(B) \geqq 60$, the shot feeling becomes rather hard.

When [A-B I], namely $20 \leqq (A) \leqq 30$ and $50 < (B) \leqq 70$, if $(B)/(A) < 1.8$, the shot feeling becomes rather soft. If $(B)/(A) > 3.0$, the shot feeling becomes rather hard and durability rather deteriorates.

When [A-B II], namely $30 \leqq (A) \leqq 45$ and $35 \leqq (B) < 60$, if $(B)/(A) < 1.0$, the shot feeling is felt a little pithy and hard. If $(B)/(A) > 1.8$, the shot feeling is felt hard.

The specific gravity (C) of the inner layer core and the specific gravity (D) of the outer layer core preferably satisfy relational expressions, $1.0 \leqq (C) \leqq 1.5$, $1.0 \leqq (D) \leqq 1.5$ and $|(C)-(D)| \leqq 0.1$. More preferably, they satisfy relational expressions, $1.0 \leqq (C) \leqq 1.3$, $1.0 \leqq (D) \leqq 1.3$ and $|(C)-(D)| \leqq 0.05$. This is because impact resilience, flying performance and shot feeling become more satisfactory.

By providing a difference in specific gravity between them, the distortion of the interface when being hit becomes large and breakage readily occurs. Therefore, the above relational expressions are preferably satisfied.

The core composition forming the core of the multi-piece solid golf ball of the present invention is not particularly limited but it comprises base rubber, a crosslinking agent, co-crosslinking agent, filler and the like which are generally used to form a core.

The base rubber is not particularly limited but natural rubber and/or synthetic rubber may be used. Butadiene rubber is preferred because flying performance becomes more satisfactory, and butadiene rubber having 40% or more of a cis-1,4 bond is particularly preferred.

The crosslinking agent is an organic peroxide, sulfur or the like. The organic peroxide is not particularly limited if it is generally used for the crosslinking of rubber, as exemplified by dicumyl peroxide, ditertiarybutyl peroxide, 1,3-bis(t-butylperoxyisopropyl)benzene, n-butyl 4,4'-di(t-butylperoxy)valerate, 2,5-dimethyl-2,5-di(t-butylperoxy) hexane and the like.

The co-crosslinking agent is not particularly limited and may be an unsaturated carboxylic acid metal salt or the like. Zinc acrylate and/or zinc methacrylate are/is preferred.

The unsaturated carboxylic acid metal salt may be used alone or may be mixed with ca. 10% of a fatty acid such as stearic acid to improve dispersibility.

The unsaturated carboxylic acid metal salt preferably has an average particle size of 5.0 μm or less. The term "average particle size" as used herein means a particle size measured by a general sedimentation particle size distribution measurement method. When the particle size is 5.0 μm or less, the dispersibility of the unsaturated carboxylic acid metal salt in the base rubber is improved at the time of kneading and flying performance becomes more satisfactory.

Crosslinking aids include zinc oxide and the like. Inert fillers include barium sulfate and the like.

The core composition forming the core of the multi-piece solid golf ball of the present invention may contain additives such as an anti-aging agent, a processing aid, a plasticizer and a softener as required in addition to the above components.

The method for producing the multi-piece solid golf ball of the present invention is not particularly limited. A method comprising the steps of forming an outer layer core prepared by press molding a core composition for an outer layer on an inner layer core obtained by press molding a core composition for an inner layer concentrically and injection molding a resin composition for the cover to cover the core is preferred.

EXAMPLES

The following examples are provided for the purpose of further illustrating the present invention but are in no way to be taken as limiting.

formation of multi-piece solid golf ball

A spherical solid core (inner layer core) was obtained by kneading raw materials for the inner layer core shown below in a weight ratio shown in Table 1 with a kneader and a roll, and heating and press molding the obtained rubber composition at 160° C. for 20 minutes. A double-layer molded body was obtained by kneading raw materials for the outer layer core shown below in a weight ratio shown in Table 1 with a kneader and a roll, and press molding the obtained rubber composition on the inner layer core concentrically. A two-piece solid core was obtained by heating and press molding the double-layer molded body at 160° C. for 20 minutes. A multi-piece solid golf ball was formed by kneading raw materials for the cover layer shown below in a weight ratio shown in Table 1 with a kneader and a roll and covering the two-piece solid core with the obtained resin composition by injection molding.

(1) raw materials for inner layer core and raw materials for outer layer core butadiene rubber: 97% of cis-1,4 bond, BR-01 (Japan Synthetic Rubber Co., Ltd.)

zinc oxide zinc acrylate: average particle size of 2.5 μm (measured by the CAPA-300 natural-centrifugal sedimentation type automatic particle size distribution measuring instrument of Horiba Seisakusho Co., Ltd.), produced by grinding zinc acrylate having an average particle size of 5.3 μm with a labo jet mill anti-aging agent: Swanox BHT of Seiko Kagaku Co., Ltd.

(2) raw materials for cover layer ionomer resin 1: sodium ionic ethylene-methacrylic acid copolymer, Shore D hardness of 67, H1605 of Mitsui Du Pont•Polychemical Co., Ltd.

ionomer resin 2: zinc ionic ethylene-methacrylic acid copolymer, Shore D hardness of 66, H1706 of Mitsui Du Pont•Polychemical Co., Ltd.

butadiene rubber: 97% of cis-1,4 bond, BR-01 of Japan Synthetic Rubber Co., Ltd.

titanium oxide: Tipake CR-60 of Ishihara Sangyo Co., Ltd.

The following tests were made on the obtained multi-piece solid golf ball. Comparative Example 17 was selected as a typical soft core/hard cover type multi-piece solid golf ball which is close to the ball of the prior art as the standards of the physical properties of a ball.

impact resilience test

A multi-piece solid golf ball is struck by a swing robot to measure the initial speed of the ball. A driver (wood #1) is used and the head speed is set to 43 m/s. When the initial speed of Comparative Example 17 is 100, a relative value of the initial speed of each ball is shown.

flying performance test

A multi-piece solid golf ball is struck by a swing robot to measure a carry. A driver (wood #1) is used and the head speed is set to 43 m/s. When the carry of Comparative Example 17 is 100, a relative value of the carry of each ball is shown.

shot feeling test

A professional golfer drives a ball with a driver (wood #1) to test its shot feeling.

durability test 5 multi-piece solid golf balls are struck by a swing robot for each Example and Comparative Example to test durability. A driver (wood #1) is used and the head speed is set to 43 m/s. When each ball is struck 100 times and any one of the 5 balls is broken, durability is judged as unsatisfactory (X) . When each ball is struck 150 times and all of the 5 ball are not broken, durability is judged as satisfactory (Δ). When each ball is struck 200 times and all of the 5 balls are not broken, durability is judged as good (O). The term "broken" means that the cover is cracked and the ball becomes unusable.

others

In addition to the above tests, the diameter of the inner layer core, the thickness of the outer layer core and the Shore D hardness of each of the inner layer core and the outer layer core were measured.

The results are shown in Table 1. It is understood from Table 1 that the multi-piece solid golf ball of the present invention (Examples 1 to 8) is excellent in impact resilience, flying performance, shot feeling and durability. It is also understood that the shot feeling can be finely adjusted by changing the Shore D hardness of the inner layer core an the Shore D hardness of the outer layer core within the range of the present invention.

In contrast to this, when the Shore D hardness of the inner layer core or the outer layer core is outside the range of the present invention as in Comparative Examples 1 to 16, there is a problem with the shot feeling or durability. When the weight ratio of the ionomer resin to the diene-based rubber in the resin composition forming the cover layer is outside the range of the present invention as in Comparative Example 17 or 18, there is a problem with the shot feeling, or impact resilience and flying performance.

A multi-piece solid golf ball having the same composition as in Example 3 except that the cover layer was made from a resin composition which comprised 40 parts by weight of the ionomer resin 1, 40 parts by weight of the ionomer resin 2, 20 parts by weight of the butadiene rubber, 1 part by weight of the titanium oxide and 1.8 parts by weight of an organic peroxide (dicumyl peroxide, Percumyl D of NOF Corporation) and was crosslinked with a peroxide had impact resilience of 101, flying performance of 100, a good shot feeling and durability evaluated as O but the discoloration (yellowish) of the cover layer was observed. The discoloration of the cover layer was not observed in other Examples 1 to 8 and Comparative Examples 1 to 18.

TABLE 1

| | Example | | | |
|---|---|---|---|---|
| | 1 | 2 | 3 | 4 |
| inner layer core | | | | |
| butadiene rubber | 100 | 100 | 100 | 100 |
| zinc oxide | 12 | 12 | 15 | 15 |
| zinc acrylate | 24 | 24 | 12 | 12 |
| anti-aging agent | 0.5 | 0.5 | 0.5 | 0.5 |
| organic peroxide | 2 | 2 | 2 | 2 |
| specific gravity of inner layer core | 1.15 | 1.15 | 1.13 | 1.13 |
| diameter of inner layer core | 25 | 25 | 25 | 25 |
| Shore D hardness of inner layer core | 40 | 40 | 25 | 25 |
| outer layer core | | | | |
| butadiene rubber | 100 | 100 | 100 | 100 |
| zinc oxide | 11 | 13 | 11 | 13 |
| zinc acrylate | 32 | 25 | 32 | 25 |
| anti-aging agent | 0.5 | 0.5 | 0.5 | 0.5 |
| organic peroxide | 2 | 2 | 2 | 2 |
| specific gravity of outer layer core | 1.18 | 1.17 | 1.18 | 1.17 |
| thickness of outer layer core | 7 | 7 | 7 | 7 |
| Shore D hardness of outer layer core | 60 | 50 | 60 | 50 |
| cover layer | | | | |
| ionomer resin 1 | 40 | 40 | 40 | 40 |
| ionomer resin 2 | 40 | 40 | 40 | 40 |
| butadiene rubber | 20 | 20 | 20 | 20 |
| titanium oxide | 1 | 1 | 1 | 1 |
| crosslinking agent | — | — | — | — |
| Shore D hardness of cover layer | 56 | 56 | 56 | 56 |
| ball performance | | | | |
| resilience index | 100 | 100 | 101 | 100 |
| index of carry | 100 | 100 | 101 | 100 |
| shot feeling | good (slightly hard) | good | good | good (slightly soft) |
| durability | ○ | ○ | ○ | ○ |

TABLE 2

| | Example | | | | |
|---|---|---|---|---|---|
| | 5 | 6 | 7 | 8 | 9 |
| inner layer core | | | | | |
| butadiene rubber | 100 | 100 | 100 | 100 | 100 |
| zinc oxide | 12 | 12 | 15 | 15 | 5 |
| zinc acrylate | 24 | 24 | 12 | 12 | 24 |
| anti-aging agent | 0.5 | 0.5 | 0.5 | 0.5 | 0.5 |
| organic peroxide | 2 | 2 | 2 | 2 | 2 |
| specitic gravity of inner layer core | 1.15 | 1.15 | 1.13 | 1.13 | 1.10 |
| diameter of inner layer core | 28 | 28 | 28 | 28 | 25 |
| Shore D hardness of inner layer core | 38 | 38 | 23 | 23 | 40 |
| outer layer core | | | | | |
| butadiene rubber | 100 | 100 | 100 | 100 | 100 |
| zinc oxide | 11 | 13 | 11 | 13 | 24 |
| zinc acrylate | 32 | 25 | 32 | 25 | 25 |
| anti-aging agent | 0.5 | 0.5 | 0.5 | 0.5 | 0.5 |
| organic peroxide | 2 | 2 | 2 | 2 | 2 |
| specific gravity of outer layer core | 1.18 | 1.17 | 1.18 | 1.17 | 1.24 |

TABLE 2-continued

| | Example | | | | |
|---|---|---|---|---|---|
| | 5 | 6 | 7 | 8 | 9 |
| thickness of outer layer core | 5.5 | 5.5 | 5.5 | 5.5 | 7 |
| Shore D hardness of outer layer core | 58 | 47 | 58 | 47 | 50 |
| cover layer | | | | | |
| ionomer resin 1 | 40 | 40 | 40 | 40 | 40 |
| ionomer resin 2 | 40 | 40 | 40 | 40 | 40 |
| butadiene rubber | 20 | 20 | 20 | 20 | 20 |
| titanium oxide | 1 | 1 | 1 | 1 | 1 |
| crosslinking agent | — | — | — | — | — |
| Shore D hardness of cover layer | 56 | 56 | 56 | 56 | 56 |
| ball performance | | | | | |
| resilience index | 101 | 101 | 101 | 100 | 100 |
| index of carry | 100 | 100 | 101 | 100 | 100 |
| shot feeling | good | good | good | good (slightly soft) | good |
| durability | ○ | ○ | ○ | ○ | Δ |

TABLE 3

| | Comparative Example | | | | |
|---|---|---|---|---|---|
| | 1 | 2 | 3 | 4 | 5 |
| inner layer core | | | | | |
| butadiene rubber | 100 | 100 | 100 | 100 | 100 |
| zinc oxide | 12 | 12 | 15 | 15 | 12 |
| zinc acrylate | 30 | 30 | 12 | 12 | 30 |
| anti-aging agent | 0.5 | 0.5 | 0.5 | 0.5 | 0.5 |
| organic peroxide | 2 | 2 | 1 | 1 | 2 |
| specific gravity of inner layer core | 1.18 | 1.18 | 1.13 | 1.13 | 1.18 |
| diameter of inner layer core | 25 | 25 | 25 | 25 | 28 |
| Shore D hardness of inner layer core | 55 | 55 | 12 | 12 | 53 |
| outer layer core | | | | | |
| butadiene rubber | 100 | 100 | 100 | 100 | 100 |
| zinc oxide | 11 | 13 | 11 | 13 | 11 |
| zinc acrylate | 32 | 25 | 32 | 25 | 32 |
| anti-aging agent | 0.5 | 0.5 | 0.5 | 0.5 | 0.5 |
| organic peroxide | 2 | 2 | 2 | 2 | 2 |
| specific gravity of outer layer core | 1.18 | 1.17 | 1.18 | 1.17 | 1.18 |
| thickness of outer layer core | 7 | 7 | 7 | 7 | 5.5 |
| Shore D hardness of outer layer core | 60 | 50 | 60 | 50 | 58 |
| cover layer | | | | | |
| ionomer resin 1 | 40 | 40 | 40 | 40 | 40 |
| ionomer resin 2 | 40 | 40 | 40 | 40 | 40 |
| butadiene rubber | 20 | 20 | 20 | 20 | 20 |
| titanium oxide | 1 | 1 | 1 | 1 | 1 |
| crossiinking agent | — | — | — | — | — |
| Shore D hardness of cover layer | 56 | 56 | 56 | 56 | 56 |
| ball performance | | | | | |
| resilience index | 101 | 98 | 100 | 98 | 101 |
| index of carry | 100 | 99 | 100 | 97 | 100 |
| shot feeling | too hard | pithy and hard | good | too soft | too hard |
| durability | ○ | ○ | X | ○ | ○ |

TABLE 4

| | Comparative Example | | | | |
|---|---|---|---|---|---|
| | 6 | 7 | 8 | 9 | 10 |
| inner layer core | | | | | |
| butadiene rubber | 100 | 100 | 100 | 100 | 100 |
| zinc oxide | 12 | 15 | 15 | 12 | 12 |
| zinc acrylate | 30 | 12 | 12 | 24 | 24 |
| anti-aging agent | 0.5 | 0.5 | 0.5 | 0.5 | 0.5 |
| organic peroxide | 2 | 1 | 1 | 2 | 2 |
| specific gravity of inner layer core | 1.18 | 1.13 | 1.13 | 1.15 | 1.15 |
| diameter of inner layer core | 28 | 28 | 28 | 25 | 25 |
| Shore D hardness of inner layer core | 53 | 10 | 10 | 40 | 40 |
| outer layer core | | | | | |
| butadiene rubber | 100 | 100 | 100 | 100 | 100 |
| zinc oxide | 13 | 11 | 13 | 10 | 14 |
| zinc acrylate | 25 | 32 | 25 | 40 | 20 |
| anti-aging agent | 0.5 | 0.5 | 0.5 | 0.5 | 0.5 |
| organic peroxide | 2 | 2 | 2 | 2 | 2 |
| specific gravity of outer layer core | 1.17 | 1.18 | 1.17 | 1.20 | 1.15 |
| thickness of outer layer core | 5.5 | 5.5 | 5.5 | 7 | 7 |
| Shore D hardness of outer layer core | 47 | 58 | 47 | 75 | 33 |
| cover layer | | | | | |
| ionomer resin 1 | 40 | 40 | 40 | 40 | 40 |
| ionomer resin 2 | 40 | 40 | 40 | 40 | |
| butadiene rubber | 20 | 20 | 20 | 20 | 20 |
| titanium oxide | 1 | 1 | 1 | 1 | 1 |
| crosslinking agent | — | — | — | — | — |
| Shore D hardness of cover layer | 56 | 56 | 56 | 56 | 56 |
| ball performance | | | | | |
| resilience index | 99 | 100 | 97 | 101 | 95 |
| index of carry | 100 | 100 | 98 | 101 | |
| shot feeling | pithy and hard | good | too soft | too hard | pithy and hard |
| durability | ○ | X | ○ | ○ | ○ |

TABLE 5

| | Comparative Example | | | | |
|---|---|---|---|---|---|
| | 11 | 12 | 13 | 14 | 15 |
| inner layer core | | | | | |
| butadiene rubber | 100 | 100 | 100 | 100 | 100 |
| zinc oxide | 15 | 15 | 15 | 12 | 15 |
| zinc acrylate | 12 | 12 | 24 | 24 | 12 |
| anti-aging agent | 0.5 | 0.5 | 0.5 | 0.5 | 0.5 |
| organic peroxide | 2 | 2 | 2 | 2 | 2 |
| specific gravity of inner layer core | 1.13 | 1.13 | 1.15 | 1.15 | 1.13 |
| diameter of inner layer core | 25 | 25 | 28 | 28 | 28 |
| Shore D hardness of inner layer core | 25 | 25 | 38 | 38 | 23 |
| outer layer core | | | | | |
| butadiene rubber | 100 | 100 | 100 | 100 | 100 |
| zinc oxide | 10 | 14 | 10 | 14 | 10 |
| zinc acrylate | 40 | 20 | 40 | 20 | 40 |
| anti-aging agent | 0.5 | 0.5 | 0.5 | 0.5 | 0.5 |
| organic peroxide | 2 | 2 | 2 | 2 | 2 |
| specific gravity of outer layer core | 1.20 | 1.15 | 1.20 | 1.15 | 1.20 |

TABLE 5-continued

| | Comparative Example | | | | |
|---|---|---|---|---|---|
| | 11 | 12 | 13 | 14 | 15 |
| thickness of outer layer core | 7 | 7 | 5.5 | 5.5 | 5.5 |
| Shore D hardness of outer layer core | 75 | 33 | 72 | 30 | 72 |
| cover layer | | | | | |
| ionomer resin 1 | 40 | 40 | 40 | 40 | 40 |
| ionomer resin 2 | 40 | 40 | 40 | 40 | 40 |
| butadiene rubber | 20 | 20 | 20 | 20 | 20 |
| titanium oxide | 1 | 1 | 1 | 1 | 1 |
| crosslinking agent | — | — | — | — | — |
| Shore D hardness of cover layer | 56 | 56 | 56 | 56 | 56 |
| ball performance | | | | | |
| resilience index | 102 | 94 | 102 | 96 | 102 |
| index of carry | 101 | 95 | 101 | 97 | 101 |
| shot feeling | good | too soft | too hard | pithy | good and hard |
| durability | X | ○ | ○ | ○ | X |

TABLE 6

| | Comparative Example | | |
|---|---|---|---|
| | 16 | 17 | 18 |
| inner layer core | | | |
| butadiene rubber | 100 | 100 | 100 |
| zinc oxide | 15 | 15 | 15 |
| zinc acrylate | 12 | 12 | 12 |
| anti-aging agent | 0.5 | 0.5 | 0.5 |
| organic peroxide | 2 | 2 | 2 |
| specific gravity of inner layer core | 1.13 | 1.13 | 1.13 |
| diameter of inner layer core | 28 | 28 | 25 |
| Shore D hardness of inner layer core | 23 | 25 | 25 |
| outer layer core | | | |
| butadiene rubber | 100 | 100 | 100 |
| zinc oxide | 14 | 11 | 11 |
| zinc acrylate | 20 | 32 | 32 |
| anti-aging agent | 0.5 | 0.5 | 0.5 |
| organic peroxide | 2 | 2 | 2 |
| specific gravity of outer layer core | 1.15 | 1.18 | 1.18 |
| thickness of outer layer core | 5.5 | 7 | 7 |
| Shore D hardness of outer layer core | 30 | 60 | 60 |
| cover layer | | | |
| ionomer resin 1 | 40 | 47.5 | 20 |
| ionomer resin 2 | 40 | 47.5 | 20 |
| butadiene rubber | 20 | 5 | 60 |
| titanium oxide | 1 | 1 | 1 |
| crosslinking agent | — | — | — |
| Shore D hardness of cover layer | 56 | 67 | 39 |
| ball performance | | | |
| resilience index | 95 | (100) | 96 |
| index of carry | 95 | (100) | 94 |
| shot feeling | too soft | too hard | good |
| durability | ○ | ○ | ○ |

Since the multi-piece solid golf ball of the present invention is excellent in impact resilience, flying performance, shot feeling and durability, it is extremely useful.

What is claimed is:

1. A multi-piece solid golf ball comprising a core consisting of an inner layer core and an outer layer core and a cover layer for covering the core, wherein the diameter of the inner layer core is 20 to 35 mm and the thickness of the outer layer core is 2 to 11 mm, and wherein the Shore D hardness (A) of the surface of the inner layer core and the Shore D hardness (B) of the surface of the outer layer core satisfy relational expressions, $15 \leqq (A) \leqq 50$, $35 \leqq (B) \leqq 70$ and $(A) \leqq (B)$, said cover layer being made from a resin composition comprising 50 to 90 parts by weight of an ionomer resin and 10 to 50 parts by weight of diene-based rubber that is dispersed in the ionomer resin and is thermally crosslinked and no crosslinking agent is present in the cover layer.

2. The multi-piece solid golf ball of claim 1, wherein the specific gravity (C) of the inner layer core and the specific gravity (D) of the outer layer core satisfy relational expressions, $1.0 \leqq (C) \leqq 1.5$, $1.0 \leqq (D) \leqq 1.5$, and $|(C)-(D)| \leqq 0.1$.

3. The multi-piece solid golf ball of claim 1 or 2, wherein the Shore D hardness of the surface of the cover layer is 40 to 65.

* * * * *